US010358615B2

(12) United States Patent
Gunawan

(10) Patent No.: US 10,358,615 B2
(45) Date of Patent: Jul. 23, 2019

(54) METHOD FOR IMPROVING LOW TEMPERATURE STABILITY OF A FRICTION MODIFIER ADDITIVE

(71) Applicant: Chevron U.S.A. Inc., San Ramon, CA (US)

(72) Inventor: Theresa Liang Gunawan, Richmond, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 15/281,360

(22) Filed: Sep. 30, 2016

(65) Prior Publication Data

US 2018/0094202 A1 Apr. 5, 2018

(51) Int. Cl.

| | |
|---|---|
| ***C10L 1/19*** | (2006.01) |
| ***C10L 1/16*** | (2006.01) |
| ***C10L 1/22*** | (2006.01) |
| ***C10L 10/14*** | (2006.01) |
| ***C10L 10/08*** | (2006.01) |
| *C10L 1/222* | (2006.01) |
| *C10L 1/182* | (2006.01) |

(52) U.S. Cl.

CPC ..... *C10L 10/14* (2013.01); *C10L 10/08* (2013.01); *C10L 1/1616* (2013.01); *C10L 1/1824* (2013.01); *C10L 1/19* (2013.01); *C10L 1/191* (2013.01); *C10L 1/221* (2013.01); *C10L 1/2222* (2013.01); *C10L 2270/023* (2013.01)

(58) Field of Classification Search

CPC ..... C10M 129/76; C10L 1/19; C10L 10/08; C10L 10/14; C10L 1/1616; C10L 1/1824; C10L 1/191; C10L 1/221; C10L 1/2222; C10L 2270/023

See application file for complete search history.

(56) References Cited

U.S. PATENT DOCUMENTS 6,277,158 B1 * 8/2001 McLean ..... C10L 1/143 44/399
2008/0282607 A1 * 11/2008 Dietz ..... C10L 1/14 44/387
2010/0210487 A1 8/2010 Deblase et al.
2015/0166922 A1 * 6/2015 DeBlase et al. ..... C10M 129/76 508/100

FOREIGN PATENT DOCUMENTS

JP 2008143939 A * 6/2008
WO WO-2014184362 A1 * 11/2014 ..... C10M 129/76

OTHER PUBLICATIONS

Ashok Pandey et al., "Industrial Biorefineries and White Biotechnology", Elsevier, 2015, pp. 127-154.
A. Gopinath et al., "Effects of the properties and the structural configurations of fatty acid methyl esters on the properties of biodiesel fuel: a review", Proc. IMechE Part D: J. Automobile Engeering, 2015, pp. 357-390, vol. 229(3).

* cited by examiner

*Primary Examiner* — Latosha Hines
(74) *Attorney, Agent, or Firm* — Ryan, Mason & Lewis, LLP

(57) ABSTRACT

Disclosed herein is a method comprising the steps of (a) providing a fuel additive concentrate comprising (i) from about 5 to about 50 wt. %, based on the total weight of the fuel additive concentrate, of one or more fatty acid sorbitan esters, and (ii) about 10 to about 95 wt. %, based on the total weight of the fuel additive concentrate, of a fuel carrier fluid, and (b) storing the fuel additive concentrate at a low temperature environment. Also disclosed is a method operating an internal combustion engine with a fuel composition comprising (a) a major amount of a fuel, and (b) a minor amount of one or more fatty acid sorbitan esters in a low temperature environment.

12 Claims, No Drawings

METHOD FOR IMPROVING LOW TEMPERATURE STABILITY OF A FRICTION MODIFIER ADDITIVE

BACKGROUND OF THE INVENTION

1. Technical Field

The present invention relates generally to a method for improving low temperature stability of a friction modifier additive and a fuel composition containing such friction modifier additive.

2. Description of the Related Art

Fuel compositions for vehicles are continually being improved to enhance various properties of the fuels in order to accommodate their use in newer, more advanced engines including direct injection gasoline engines. Accordingly, fuel compositions typically include additives that are directed to certain properties that require improvement. For example, friction modifiers, such as partial esters of fatty acid and polyols, are added to fuel to reduce friction and wear in the fuel delivery systems of an engine.

Current practice in the supply of gasoline is generally to pre-mix the fuel additives into a concentrate in a hydrocarbon solvent base, and then to inject the concentrate from an additives tank into a set amount of base gasoline via pipelines to fill tankers prior to delivery to the customer. To facilitate injection of the concentrate, especially in the correct component ratios of the concentrate package, into the gasoline, it is important that the concentrate is in the form of a low viscosity, homogeneous liquid. Problems have been encountered in achieving a stable concentrate due to the poor solubility of conventional friction modifiers, especially at low temperatures. In particular, the partial esters of fatty acid and polyols such as glycerol monooleate (GMO) are known friction modifiers for lubricant compositions. While partial esters of fatty acid and polyols such as GMO friction modifiers may improve fuel economy when added to a lubricant, the partial esters of fatty acid and polyols can be unstable in additive packages for fuels. In particular, due to the fatty and sometimes waxy nature of the fatty acids and their derivatives, concentrated additive packages containing such materials tend to have poor low temperature storage stability. This poor low temperature storage stability is seen in the formation of solids, sediments and/or thick gels in the additive packages containing these materials. This low temperature storage stability results in poor handling characteristics of packages containing these additives, especially in northern and/or cooler climates where the packages may be regularly exposed to cooler temperatures.

The solubility of the friction modifier may be assisted by employing solubilizing agents. However, the amount of solubilizing agent required to solubilize the desired level of friction modifier in the concentrate often exceeds the maximum amount possible given the constraints on the amount of concentrate that can be injected into the gasoline, and the amount of solubilizing agent that can be contained in the concentrate. In addition, some solubilizing agents tend to alter the properties of the friction modifier, to be reactive with contaminants or chemical components resulting from refinery processes used in the production of base gasoline, or other additives contained in the concentrate, causing chemical degradation and/or a reduction in performance in the resulting gasoline composition.

Accordingly, there is a need for an improved friction modifier additive other than the partial esters of fatty acids and polyols that provides friction reduction while being stable over the temperature range at which the friction modifier additive may feasibly be stored, or used in low temperature regions and which does not adversely affect the performance and properties of the finished fuel or engine in which the fuel is used.

SUMMARY OF THE INVENTION

In accordance with one embodiment of the present invention, there is provided a method comprising the steps of (a) providing a fuel additive concentrate comprising (i) from about 5 to about 50 wt. %, based on the total weight of the fuel additive concentrate, of one or more fatty acid sorbitan esters, and (ii) about 10 to about 95 wt. %, based on the total weight of the fuel additive concentrate, of a fuel carrier fluid, and (b) storing the fuel additive concentrate to a low temperature environment.

In accordance with a second embodiment of the present invention, there is provided a method comprising operating an internal combustion engine with a fuel composition comprising (a) a major amount of a fuel, and (b) a minor amount of one or more fatty acid sorbitan esters in a low temperature environment.

In accordance with a third embodiment of the present invention, there is provided a method comprising operating an internal combustion engine with a fuel composition comprising (a) a major amount of a fuel, and (b) a minor amount of a fuel additive concentrate comprising (i) from about 5 to about 50 wt. %, based on the total weight of the fuel additive concentrate, of one or more fatty acid sorbitan esters, and (ii) about 10 to about 95 wt. %, based on the total weight of the fuel additive concentrate, of a fuel carrier fluid, in a low temperature environment.

The present invention is based on the surprising discovery that a fuel additive concentrate comprising one or more fatty acid sorbitan esters can advantageously be stored at low temperatures with little to no stability problems, e.g., formation of sediment, cloudiness, etc. In addition, the fatty acid sorbitan ester friction modifiers are also able to have improved low temperature compatibility in a fuel composition when used in a low temperature environment.

DETAILED DESCRIPTION OF THE PREFERRED EMBODIMENTS

In one embodiment, a method is provided comprising the steps of (a) providing a fuel additive concentrate comprising (i) from about 5 to about 50 wt. %, based on the total weight of the fuel additive concentrate, of one or more fatty acid sorbitan esters, and (ii) about 10 to about 95 wt. %, based on the total weight of the fuel additive concentrate, of a fuel carrier fluid, and (b) storing the fuel additive concentrate in a low temperature environment, e.g., at a temperature of from about 0° C. and below, or from about −5° C. and below, or from about −20° C. and below.

The one or more fatty acid sorbitan esters for use in the fuel additive in accordance with the present invention are obtained by subjecting a fatty acid to ester bonding, i.e., esterification, with one or more of the OH groups of sorbitan. Alternatively, the one or more fatty acid sorbitan esters are commercially available from such sources as, for example, Santa Cruz Biotechnology, Inc., Sigma-Aldrich, and Alfa Aesar. As one skilled in the art will readily understand, sorbitan esters can be mono-, di-, tri- and/or tetraesters. In one embodiment of the present invention, the fatty acid moiety of the fatty acid sorbitan esters has from about 4 to about 28 carbon atoms, or from about 6 to about 24 carbon atoms, or from about 8 to about 22 carbon atoms, or from about 10 to about 18 carbon atoms, or from about 12 to about 18 carbon atoms or from about 16 to about 18 carbon atoms.

Fatty acids are a class of compounds containing a long hydrocarbon chain and a terminal carboxylate group and are characterized as unsaturated or saturated depending upon whether a double bond is present in the hydrocarbon chain. Therefore, an unsaturated fatty acid has at least one double bond in its hydrocarbon chain whereas a saturated fatty acid has no double bonds in its fatty acid chain. Representative examples of unsaturated fatty acids include, but are not limited to, myristoleic acid, palmitoleic acid, oleic acid, linolenic acid, and the like. Representative examples of saturated fatty acids include, but are not limited to, caproic acid, caprylic acid, capric acid, lauric acid, myristic acid, palmitic acid, stearic acid, arachidic acid, behenic acid, lignoceric acid, and the like. In one embodiment, the fatty acid (and the resulting fatty acid sorbitan ester composition of the invention) comprises a mixture of fully saturated fatty acids and partially unsaturated fatty acids. In other embodiments, such fatty acids may be substituted at any one or more of the carbons. The substituents may include, for example, one or more alkyl, aryl, acyl, alkoxy and/or branched alkyl(iso-stearic) groups.

Representative examples of suitable fatty acid sorbitan esters include, but are not limited to, sorbitan monolaurate, sorbitan monopalmitate, sorbitan monostearate, sorbitan monoisostearate, sorbitan monooleate, sorbitan monolinoleate, sorbitan dilaurate, sorbitan dipalmitate, sorbitan distearate, sorbitan diisostearate, sorbitan dioleate, sorbitan dilinoleate, sorbitan lauryl palmityl diester, sorbitan lauryl stearyl diester, sorbitan lauryl isostearyl diester, sorbitan lauryl oleyl diester, sorbitan lauryl linoleyl diester, sorbitan palmityl stearyl diester, sorbitan palmityl isostearyl diester, sorbitan palmityl oleyl diester, sorbitan palmityl linoleyl diester, sorbitan stearyl isostearyl diester, sorbitan stearyl oleyl diester, sorbitan stearyl linoleyl diester, sorbitan isostearyl oleyl diester, sorbitan isostearyl linoleyl diester, sorbitan trilaurate, sorbitan tripalmitate, sorbitan tristearate, sorbitan triisostearate, sorbitan trioleate, sorbitan trilinoleate, sorbitan tetralaurate, sorbitan tetrapalmitate, sorbitan tetrastearate, sorbitan tetraisostearate, sorbitan tetraoleate, sorbitan tetralinoleate, sorbitan sequioleate and mixtures thereof and the like. In one embodiment, the fatty acid sorbitan ester comprises a mixture of several fatty acid sorbitan esters.

In general, the amount of the fatty acid sorbitan esters contained in the fuel additive concentrate is from about 5 to about 50 wt. %, or from about 5 to about 45 wt. %, or from about 5 to about 40 wt. %, based on the total weight of the fuel additive concentrate. In one embodiment, the amount of the fatty acid sorbitan esters contained in the fuel additive concentrate is from about 5 wt. % to about 30 wt. %, based on the total weight of the fuel additive concentrate.

The fuel carrier fluid may be any suitable carrier fluid that is compatible with the gasoline and is capable of dissolving or dispersing the components of the fuel additive package. Typically it is a hydrocarbon fluid, for example a petroleum or synthetic lubricating oil basestock including mineral oil, synthetic oils such as polyesters or polyethers or other polyols, or hydrocracked or hydroisomerized basestock. Alternatively the carrier fluid may be a distillate boiling in the gasoline range. The amount of carrier fluid contained in the fuel additive concentrate is from about 10 to about 95 wt. %, or from about 20 to about 80 wt. %, or from about 30 to about 70 wt. %, based on the total weight of the fuel additive concentrate. In one embodiment, the amount of carrier fluid contained in the fuel additive concentrate is from about 50 to about 95 wt. %, based on the total weight of the fuel additive concentrate.

In one embodiment, a suitable solvent can be added to fuel additive concentrate to assist in preventing crystallization of the additive package at a low temperature environment. A suitable solvent is a low molecular weight alcohol such as a $C_1$ to $C_{12}$ alcohol. Representative examples include, but are not limited to, methanol, ethanol, isopropanol, butanol, 2-ethylhexanol, and the like. Generally the amount of solvent employed is up to about 50 wt. % based on the total weight of the additive concentrate, for example, from 0 to 30 wt. % or from 5 to 30 wt. %. In one embodiment, no solvent is used in the fuel additive concentrate.

In accordance with one embodiment, the fuel additive concentrate in accordance with the present invention will have a kinematic viscosity at −18° C., ranging from about 50 to about 1000 $mm^2/s$ as determined by ASTM D445.

In accordance with one embodiment, the fuel additive concentrate in accordance with the present invention will have a kinematic viscosity at 40° C., ranging from about 5 to about 50 $mm^2/s$ as determined by ASTM D445.

Once the fuel additive concentrate is obtained, it is then stored in, e.g., a tank or tanker, at a low temperature environment prior to being used in a fuel. For example, the fuel is stored in a cold climate region, e.g., a region having temperatures below freezing, such as from about 0° C. and below, or from about −5° C. and below, or from about −20° C. and below. In one embodiment, the fuel additive concentrate is stored at a temperature below about 0° C. for a time period up to about 14 days. In one embodiment, the fuel additive concentrate is stored at a temperature of about −5° C. or below for a time period up to about 14 days. In one embodiment, the fuel additive concentrate is stored at a temperature from about 0° C. down to about −5° C. for a time period up to about 30 days, e.g., from 7 days to about 30 days. In one embodiment, the fuel additive concentrate is stored at a temperature of from about −5° C. or below for a time period up to about 30 days.

The fuel additive concentrate is then incorporated into the gasoline or other fuel by, for example, injection. However, any suitable method of incorporation may be used. To facilitate injection, the kinematic viscosity of the fuel additive concentrate is generally less than 300 $mm^2/s$ at −10° C., more preferably from 5 to 250 $mm^2/s$ at −10° C., and most preferably from 10 to 200 $mm^2/s$ at −10° C. To achieve this viscosity, an aromatic solvent such as toluene, xylene, a solvent mixture of $C_9$ aromatic hydrocarbon compounds, and the like is usually added to the concentrate.

In another embodiment, a fuel composition is provided comprising a major amount of a fuel and a minor amount of the foregoing fuel additive concentrate. The fuel used in the fuel composition of this invention is present in a major amount, e.g., an amount greater than about 50 wt. %, or greater than about 70 wt. %, or greater than about 80 wt. %, based on the total weight of the composition. The fuel is generally a petroleum hydrocarbon useful as a fuel, e.g., gasoline, for internal combustion engines. Such fuels typically comprise mixtures of hydrocarbons of various types, including straight and branched chain paraffins, olefins, aromatics and naphthenic hydrocarbons. These compositions are provided in a number of grades, such as unleaded and leaded gasoline, and are typically derived from petroleum crude oil by conventional refining and blending processes such as straight run distillation, thermal cracking, hydrocracking, catalytic cracking and various reforming processes. Gasoline may be defined as a mixture of liquid hydrocarbons or hydrocarbon-oxygenates having an initial boiling point in the range of about 20 to 60° C. and a final boiling point in the range of about 150 to 230° C., as determined by the ASTM D86 distillation method. The gasoline may contain small amounts, e.g., up to 20 wt. % and typically about 10 wt. %, of other combustibles such as alcohol, for example, methanol or ethanol.

Other fuels which may be used include combustible fuels such as kerosene, diesel fuels, home heating fuels, jet fuels etc.

In general, the fuel additive or fuel additive concentrate can be present in the fuel composition in an amount of from about 50 parts per million weight (ppmw) to about 1 wt. %, based on the total weight of the fuel composition. In one embodiment, the fuel additive or fuel additive concentrate can be present in the fuel composition in an amount of from about 200 ppmw to about 500 ppmw, based on the total weight of the fuel composition.

The fuel additive concentrate or fuel composition may also contain one or more other fuel additives typically contained in a fuel additive concentrate or fuel composition. These additional additives include, but are not limited to, detergents, cetane improvers, antioxidants, metal deactivators, dyes, markers, corrosion inhibitors, antistatic additives, drag reducing agents, demulsifiers, dehazers, anti-icing additives, lubricity additives, combustion improvers, anti-knock agents and the like, in known and conventional amounts. Generally, each of these additional components is included in the concentrate or fuel composition in an amount which corresponds to a treat level of from about 1 to about 500 ppmw in the finished fuel composition.

In general, the foregoing fuel composition can be used in both fuel-injected and non fuel-injected engines. For example, the fuel composition can be used in any type of internal combustion engine, such as two-stroke engines, four-stroke engines, and vehicle engines, e.g., automobile engines, diesel motorcycle engines, jet engines, marine engines, truck/bus engines, and the like. The engine is advantageously operated with the fuel composition in a low temperature environment. As one skilled in the art will readily appreciate, a low temperature environment is an environment which may correspond to temperatures below freezing, e.g., from about 0° C., and below, or from about −5° C. and below, or even below about −20° C.

The following non-limiting examples are illustrative of the present invention.

Example 1

Preparation of Stock Solution without 2-Ethylhexanol

A stock solution was prepared in a 1-liter amber glass Boston round bottle by adding a mixture of amine-containing detergents (436.51 g, 35.76 wt. %), a $C_9$ aromatic solvent (262.78 g, 89.84 wt. %), and fuel additive concentration marker (3.97 g, 0.82 wt. %). The Boston bottle was then capped and briefly shaken by hand to afford a homogeneous fuel additive concentrate stock solution without 2-ethylhexanol.

Example 2

Preparation of a Stock Solution with 2-ethylhexanol

A solution was made in a 1-liter amber glass Boston round bottle by adding adding a mixture of amine-containing detergents (146.48 g, 65.99 wt. %), a $C_9$ aromatic solvent (99.6 g, 30.52 wt. %), fuel additive concentration marker (2.85 g, 0.87 wt. %), and 2-ethylhexanol (77.39 g, 23.72 wt. %). The Boston bottle was then capped and briefly shaken by hand to afford a homogeneous fuel additive concentrate stock solution containing 2-ethylhexanol as the diluent.

Procedure for Cold Temperature Testing

A cold temperature test solution was made by blending a friction modifier with the appropriate stock solution of Examples 1 or 2 as set forth below in Examples 3 and 4 and Comparative Examples A and B. The amount of friction modifier was calculated and weighed out into a 30 mL clear glass vial such that 19.03 wt. % of friction modifier would be in the final test solution. The appropriate quantity of stock solution of Examples 1 or 2 was then added to the glass vial to bring to resultant solution to the final desired weight for the test solution. The vial was capped and shaken by hand until the solution was homogeneous and then placed in a cold well set at between 0° C. to −5° C. The test solutions were inspected visually each day to monitor solution clarity and sediment prevalence at set time intervals for 28 days according to a modified ASTM D4176 method utilizing a more detailed rating system as set forth in Table 1. At the end of each week, written observation were made using the rating system in Table 1. The prepared cold temperature test solution of Examples 3 and 4 and Comparative Examples A and B and results are set forth below in Table 2. Acceptable ratings are 0-2 for the fluid phase and 0-1 for sediment.

TABLE 1

COMPATABILITY RATING

| Fluid Phase | Sediment | Description |
|---|---|---|
| 0 | | Absolutely Bright |
| 1 | | Bright |
| 2 | | Slight Cloud |
| 3 | | Moderate Cloud |
| 4 | | Detectable Floc |
| 5 | | Heavy Floc |
| 6 | | Heavy Cloud |
| | 0 | No Sediment |
| | 1 | Very Slight Sediment |
| | 2 | Slight Sediment |
| | 3 | Heavy Sediment |

TABLE 2

| | Ex./Comp Ex. | | | |
|---|---|---|---|---|
| Components (wt. %) | Ex. 3 | Ex. 4 | Comp. Ex. A | Comp. Ex. B |
| Sorbitan monolaurate | 19.02 | — | — | — |
| Sorbitan sesquioleate | — | 19.00 | — | — |
| Glycerol monooleate | — | — | 19.03 | 19.00 |
| Mixture of amine-containing detergents | 36.52 | 36.52 | 36.41 | 36.41 |
| $C_9$ aromatic solvent | 43.80 | 43.81 | 43.79 | 24.72 |
| fuel additive concentration marker | 0.66 | 0.66 | 0.66 | 0.71 |
| 2-ethylhexanol | — | — | — | 19.21 |
| Rating on last passing day | 1/1 | 2/0 | 1/0 | 1/0 |
| Days Passing | >28 | 7 | 1 | 2 |
| Rating after failing | N/A | 2/3 | 2/4 | 1/2 |

As the data show in Table 2, Examples 3 and 4 containing the fatty acid sorbitan ester friction modifier significantly and unexpectedly passed a greater number of days from between 0° C. to −5° C. than Comparative Examples A and B containing the glycerol monooleate friction modifier.

While the above description contains many specifics, these specifics should not be construed as limitations of the invention, but merely as exemplifications of preferred embodiments thereof. Those skilled in the art will envision many other embodiments within the scope and spirit of the invention as defined by the claims appended hereto.

What is claimed is:

1. A method comprising the steps of (a) receiving a fuel additive solution consisting of (i) from about 5 to about 50 wt. %, based on the total weight of the fuel additive solution, of one or more fully saturated fatty acid sorbitan esters selected from the group consisting of sorbitan monolaurate, sorbitan monopalmitate, sorbitan monostearate, and sorbitan monoisostearate, (ii) about 10 to about 95 wt. %, based on the total weight of the fuel additive solution, of a hydrocarbon fluid, and (iii) optionally, one or more fuel additives selected from the group consisting of a detergent, cetane improver, antioxidant, metal deactivator, dye, marker, corrosion inhibitor, antistatic additive, drag reducing agent, demulsifier, dehazer, anti-icing additive, lubricity additives, combustion improver, and anti-knock agent; and (b) storing the fuel additive solution in a low temperature environment corresponding to a temperature from about 0° C. and below.

2. The method of claim 1, wherein the hydrocarbon fluid is a petroleum or synthetic lubricating oil basestock.

3. The method of claim 1, wherein the fuel additive solution consists of from about 50 to about 95 wt. based on the total weight of the fuel additive solution, of the fuel carrier fluid.

4. The method of claim 1, wherein the fuel additive solution consists of from about 5 to about 30 wt. %, based on the total weight of the fuel additive solution, of the one or more fully saturated fatty acid sorbitan esters.

5. The method of claim 1, wherein the low temperature environment corresponds to a temperature of about −5° C. and below.

6. A method comprising operating an internal combustion engine with a fuel composition consisting of (a) a major amount of a fuel, and (b) a minor amount of one or more fully saturated fatty acid sorbitan esters selected from the group consisting of sorbitan monolaurate, sorbitan monopalmitate, sorbitan monostearate, and sorbitan monoisostearate in a low temperature environment corresponding to a temperature from about 0° C. and below, wherein the one or more fully saturated fatty acid sorbitan esters are present in a fuel additive solution consisting of (i) from about 5 to about 50 wt. %, based on the total weight of the fuel additive solution, of the one or more fully saturated fatty acid sorbitan esters; (ii) about 10 to about 95 wt. %, based on the total weight of the fuel additive solution, of a hydrocarbon fluid; and (iii) optionally, one or more fuel additives selected from the group consisting of a detergent, cetane improver, antioxidant, metal deactivator, dye, marker, corrosion inhibitor, antistatic additive, drag reducing agent, demulsifier, dehazer, anti-icing additive, lubricity additives, combustion improver, and anti-knock agent.

7. The method of claim 6, wherein the minor amount of the one or more fully saturated fatty acid sorbitan esters is from about 50 parts per million weight (ppmw) to about 1 wt. %.

8. The method of claim 6, wherein the hydrocarbon fluid is a petroleum or synthetic lubricating oil basestock.

9. The method of claim 6, wherein the low temperature environment corresponds to a temperature of from about −5° C. and below.

10. A method comprising the steps of (a) receiving a fuel additive solution consisting of (i) from about 5 to about 50 wt. %, based on the total weight of the fuel additive solution, of one or more fully saturated fatty acid sorbitan esters selected from the group consisting of sorbitan monolaurate, sorbitan monopalmitate, sorbitan monostearate, and sorbitan monoisostearate, (ii) about 10 to about 95 wt. %, based on the total weight of the fuel additive solution, of a hydrocarbon fluid, (iii) a low molecular weight alcohol solvent; and (iv) optionally, one or more fuel additives selected from the group consisting of a detergent, cetane improver, antioxidant, metal deactivator, marker, corrosion inhibitor, antistatic additive, drag reducing agent, demulsifier, dehazer, anti-icing additive, lubricity additives, combustion improver, and anti-knock agent; and (b) storing the fuel additive solution in a low temperature environment corresponding to a temperature from about 0° C. and below.

11. The method of claim 10, wherein the low molecular weight alcohol solvent is a $C_1$ to $C_{12}$ alcohol.

12. The method of claim 10, wherein the low molecular weight alcohol solvent is present in an amount of up to about 50 wt. % based on the total weight of the fuel additive solution.

* * * * *